United States Patent [19]

Leonard et al.

[11] 4,284,277

[45] Aug. 18, 1981

[54] KICK BALL GAME AND APPARATUS KIT THEREFOR

[76] Inventors: David J. Leonard; Lanita Leonard, both of 5520 S. Sheridan Rd., Muskegon, Mich. 49444

[21] Appl. No.: 941,306

[22] Filed: Sep. 11, 1978

[51] Int. Cl.[3] ..... G09B 71/02

[52] U.S. Cl. ..... 273/411

[58] Field of Search ..... 272/3; 273/1 B, 1 D, 273/95 R, 95 H, 29 B, 29 BB, 29 BA, 411

[56] References Cited

U.S. PATENT DOCUMENTS

| | | | |
|---|---|---|---|
| 3,393,913 | 7/1968 | Safina | 273/411 X |
| 3,926,433 | 12/1975 | Jacques | 273/95 H X |
| 3,968,968 | 7/1976 | Peterson | 273/95 H |
| 3,982,758 | 9/1976 | Howes, Jr. | 273/95 H X |
| 4,109,910 | 8/1978 | Gleason | 273/95 BB |

FOREIGN PATENT DOCUMENTS

| | | | |
|---|---|---|---|
| 2335693 | 1/1975 | Fed. Rep. of Germany | 273/348 |

OTHER PUBLICATIONS

Washington Post Article, "Dips, Strikers Unveil Indoor Soccer", Jan. 5, 1978, p. C8.

*Physical Education Handbook;* 6th Edition, Prentice Hall, Inc., pp. 433, 436, Title Page, Received Feb. 6, 1975.

*Primary Examiner*—William H. Grieb

*Attorney, Agent, or Firm*—Robert F. Hess

[57] ABSTRACT

A playing surface for playing a kick ball game between opposing teams divided into team zones and including a goal at each end through which the ball is to be kicked by one or the other team and wherein the playing surface is enclosed by a fabric type mesh net to contain the ball within the playing surface as well as to provide a surface off of which the ball may be ricocheted as part of the strategy of play; and complete apparatus for such a game provided in the form of a kit.

3 Claims, 4 Drawing Figures

KICK BALL GAME AND APPARATUS KIT THEREFOR

BACKGROUND OF THE INVENTION

The present invention relates to a game which can be played as a competitive team sport between two opposing groups or teams having no special physical skills nor special equipment, other than, at most, some familiarity with the game of soccer or, in the alternative, hockey. Too many competitive sports today place special emphasis on physical attributes of height, weight, speed, coordination, age and all sorts of skills impossible to develop or retain by the average person. All too often also, any organized league play of such team games as hockey, football, baseball, even soccer, requires special expensive player equipment. The present invention does not. Very few, if any of the aforementioned types of games are designed for play with equal suitability in both indoors and outdoors.

SUMMARY OF THE INVENTION

The invention is directed toward a game played by two teams on a generally rectangular playing surface, either indoors or outdoors, bounded on all sides by a flexible fence type barrier and having a generally hockey type goal at each end and wherein it is the object of each team to kick a soccer type ball into the opponent's goal. The rules of the game are unique, but nevertheless they include enough of the basic rudiments of the games of soccer and ice hockey that anyone previously associated with either game will quickly grasp an understanding of the rules and a high level of awareness of whatever skill and strategy is involved.

DETAILED DESCRIPTION OF THE PREFERRED EMBODIMENT

Figure 1:
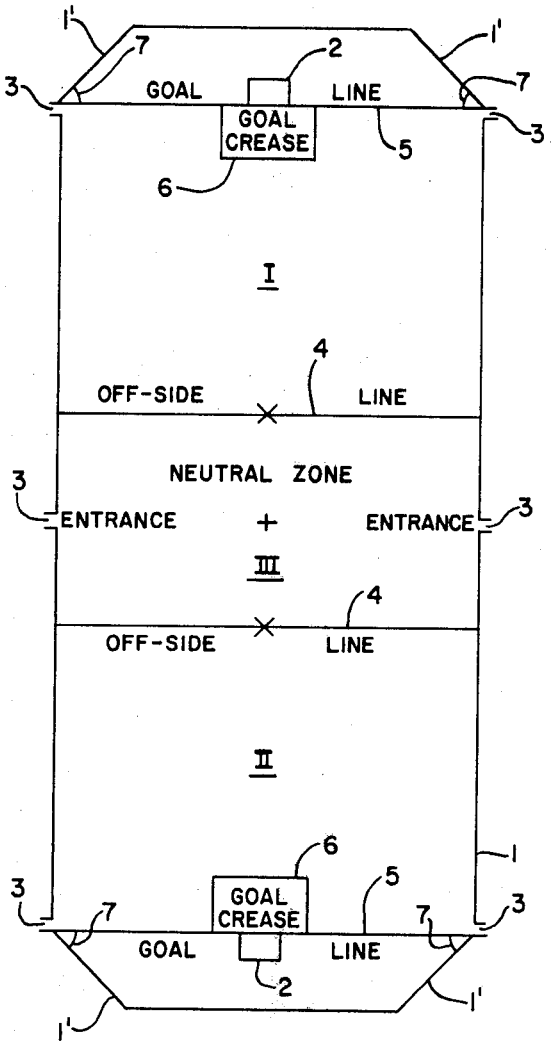
FIG. 1 is a plan view of the playing surface of the present invention.

Referring now to FIGS. 1–4, the playing surface is a generally rectangular area bounded on all sides by a barrier 1,1'. Within the playing area are located two goals 2. Leading to the playing surface are a plurality of entranceways 3. At each of the four corners of the field the barrier 1 can include obliquely directed sections 1' which, as will be more fully apparent later in this description, aid in keeping the game in play. The playing surface can be laid out indoors or outdoors, on a hardwood court or on field grass. It is divided into three playing zones, namely, zones I, II, and III. Zones I and II are of equal size and are designated alternatively a team's attacking zone or defensive zone dependent upon whether the team's goal which it is defending is located in such zone (in which case it is a defensive zone) or at the other end of the playing surface (in which case it is the attacking zone). The playing surface is divided into such zones by an off-side line 4. While any size playing surface is seemingly satisfactory, it is preferred the playing surface measure in length from 100'–200' and 50' to 100' in width, and that the neutral zone be centrally located and vary in length in the ratio of ½ the length of each of the zones I and II. The game can be played without the neutral zone and it has been found interesting to do so where the playing surface is less than 130' in length.

The barrier should be at least 4' high along the sides and 6' high behind each goal 2. As for the goals, 2, while any size may be acceptable it is preferred each measure 6' wide, 8' wide and 4' deep. A goal line 5 is laid out at each end transverse of the playing surface and preferably 14' from each end. The mouth of each goal 2 is placed on the line facing the neutral zone III and a rectangular goal crease area 6 is laid out at each end of the playing surface central of the longitudinal centerline of the playing surface and goal and extending 12' out from the goal line and measuring 20' in width. A corner throw-in position 7 is also laid out adjacent the ends of each goal line.

Figure 2:
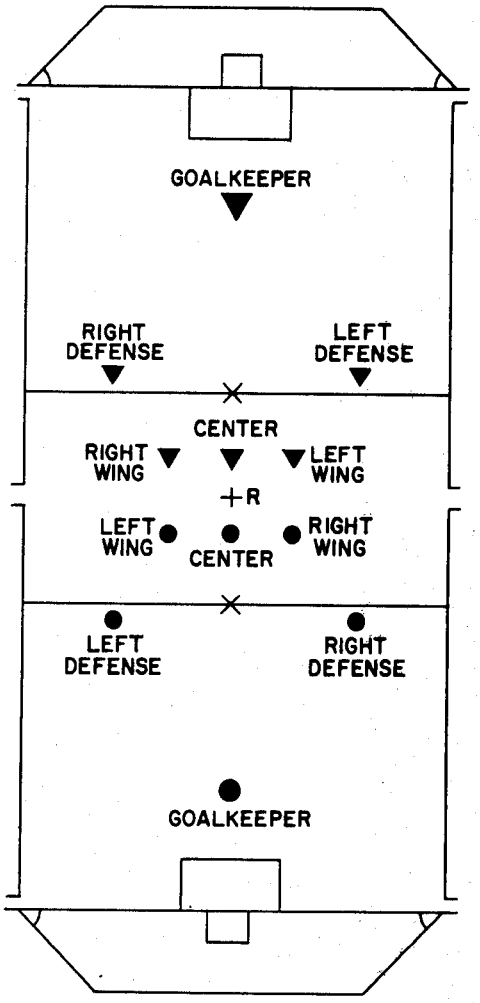
FIG. 2 in a plan view of the playing surface of the present invention as shown in FIG. 1 and indicates player designations and relative player positions during a particular segment of the game.

FIG. 2 is identical to FIG. 1 but is absent the numerals thereof in order to more clearly illustrate the title of the players on each team and their respective positions on the playing surface at the time of initial face-off. The player positions will change throughout the game in accordance with its rules.

Figure 3:
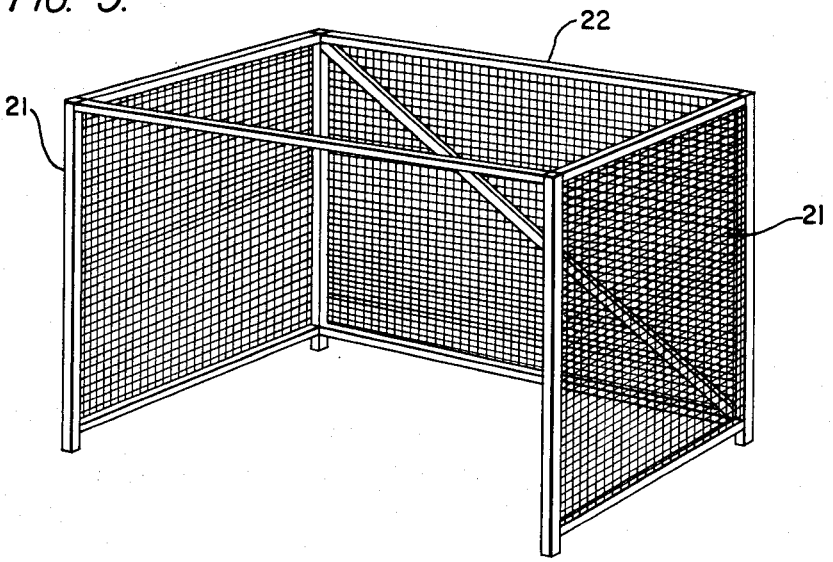
FIG. 3 is a perspective view of the goals used in my invention as seen from the front or open end.

FIG. 3 shows one form of goal 2 which has been found satisfactory. It is of rectangular box shape and wood frame construction and is open at the front, top and bottom. It is bounded by wire mesh fence such as that commonly known as chicken wire or fence wire at its two side panels 21 and back panel 22.

Figure 4:
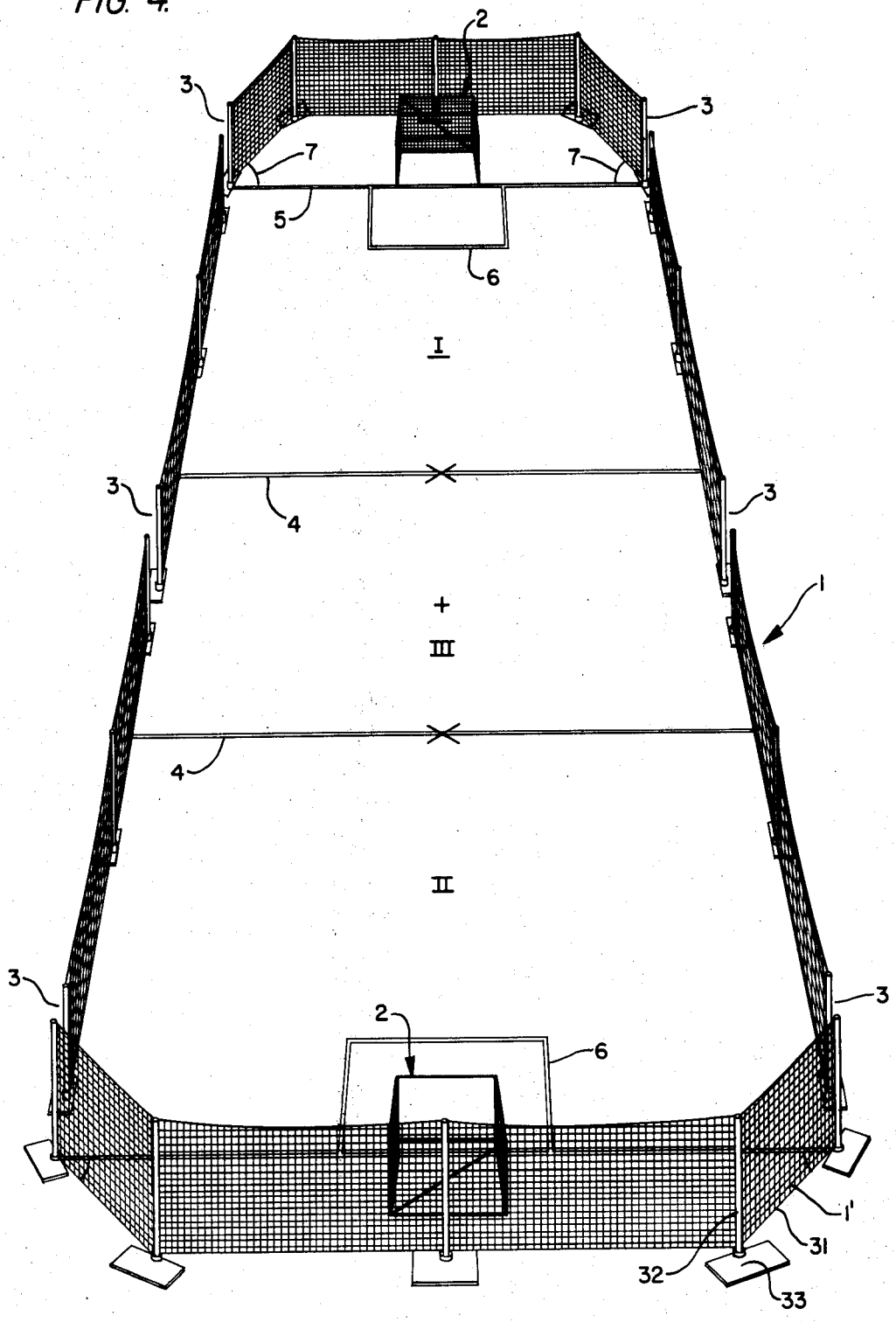
FIG. 4 is a perspective view of the playing surface of the present invention and showing the goals and wall like barrier.

FIG. 4 shows the game structure in perspective. The barrier 1,1' comprises a flexible fence like fabric 31, such as an open weave type chicken wire or fox wire, securely anchored to posts 32 which are in turn each fixed securely with respect to ground by means such as a weighted base portion 33. For purposes of portability it has been found very satisfactory to use ¼ inch nylon mesh net, with approximately 2" square mesh detachably secured to each of the poles 32 and to likewise include means for easily detaching the pole 32 from its respective base portion 33. It is not necessary nor even desirable that the base portion 33 be secured in any way to the playing surface.

The ball used in the game of the present invention is preferably of soccer ball construction and measuring between 23 and 24 inches in circumference and weighing between 12 to 14 ounces. Thus, it is slightly smaller than an official size and weight soccer ball. The ball, barrier, poles and base portions can be provided in the form of a kit with a rules book and instruction manual for establishing a playing surface.

Basic Rules of the Game

Basic rules of the game are as set forth below. Those experienced in formal league play will realize the necessity for a more comprehensive set of rules and these have been developed by the inventor. However, the following are considered sufficient for most purposes of organized or semi-organized play.

Periods and Time of Game a. Official games have three periods running 15 or 20 minutes long with running or stop time. Naturally, when the game is played informally, the length of the game is up to the players or the time available.

b. Informal games can begin either by a face-off at the center of the playing surface or by allowing one team to begin advancing the ball toward their opponent's goal from their own Defensive Zone. This same option exists after the scoring of a goal with the team having been scored upon initiating play from their own Defensive Zone.

Composition of Teams

A team can be composed of as few persons as 3 and as many as 16. A maximum of 6 players for each team are on the playing surface at one time. In a gym with a smaller playing surface, a maximum of 5 players for each team should be used on the playing surface at one time. The basic positions are similar to ice hockey, and as shown in FIG. 2 includes an offensive unit for each team comprising a left wing, right wing and center, and a defensive unit for each team comprising a left defensive person, right defensive person and goalkeeper.

The Play of the Goalkeeper a. Each team shall be allowed one goalkeeper on the playing surface at one time.

b. The goalkeeper is not required to stay in the crease and can participate as an attacking player; but he/she can only use the hands in his/her own crease.

Penalty Kick a. Any infraction of the rules which calls for a "Penalty Kick" shall be taken as follows: the ball shall be placed in the center of the non-offending team's attacking off-side line, and the player taking the shot shall play the ball from there and shall attempt to score on the goalkeeper. The player taking the shot must at all times advance the ball; keeping the ball in motion toward the opponent's goal line and, once the ball is shot, the play shall be considered complete.

b. The goalkeeper must remain in his/her crease until the player taking the penalty shot has touched the ball, then the goalkeeper may attempt to stop the shot in any manner except by throwing an object or by using the hands outside the goal crease.

If the goalkeeper throws anything, a goal will be awarded. If the goalkeeper uses the hands outside the goal crease and the shot fails, then another shot will be awarded. If the goalkeeper uses the hands outside the goal crease a second time, a goal will be awarded.

c. The player taking a shot when a penalty kick is called for will take the penalty shot.

d. During a penalty kick, all other players must remain behind the offended team's attacking off-side line until the play is complete.

Goalkeeper's Penalties a. If timed penalties are being used and a goalkeeper commits a penalty, the goalkeeper will be treated like any other player and the offending team must designate one of the other players on the playing surface as a goalkeeper.

b. The goalkeeper may take three steps with the ball. The goalkeeper must have at least one foot inside the crease whenever his or her hands are used to control the ball. The goalkeeper has the option of kicking the ball or throwing the ball in any fashion. If the goalkeeper holds the ball for more than 5 secs., his or her team is penalized for delay of game and the opposing team gets a "corner throw-in" from the corner in their attacking zone closest to the infraction.

c. If the goalkeeper or any defensive player uses his or her hands intentionally outside the crease to block a sure shot on goal, a penalty shot will be awarded to the non-offending team.

Playing the Ball—Not the Person a. The ball must be played rather than the person. Anytime that it is evident that a person is hindered physically, whether intentionally or not, this is a penalty and the non-offending team gets possession of the ball according to the rules.

(Note: Examples of playing the person instead of the ball: Fence-checking, charging, elbowing or kneeing, holding, interference, deliberate kicking of a player, tripping or unnecessary roughness).

b. If players of both teams commit a penalty at the same time, a Face-off will take place at the point of the infraction; or, if behind a goal line or within 12 ft. of a goal, the Face-off will take place at the center of the closest off-side line.

Face-Offs a. The ball shall be faced-off by a referee or someone by dropping the ball on the playing surface between the two players facing-off. The ball must touch the surface before a player can touch it. Players facing-off will stand approximately 4 to 6 ft. apart squarely facing their opponent's goal.

No player shall be allowed to come within 15 ft. of the players facing-off the ball, and all the players must remain behind the imaginary line of the ball on their respective sides. If there is an infraction, the non-offending team shall receive a "free-kick" from the point of the face-off.

b. At the beginning of each period and after a goal is scored, play will begin with a face-off at the center of the playing surface. An option in informal play is to allow one of the teams to begin to advance the ball from its end of the playing surface by mutual agreement, thus doing away with the face-off.

c. When an infringement of a rule has been committed by players of both sides in the play resulting in a stoppage or in cases where play is permitted to be completed, the ensuing face-off will be made at the center of the closest off-side line, unless otherwise expressly provided for by the rules.

d. When the game is stopped for any reason not specifically covered in these rules, the ball must be faced-off at the center of the closest off-side line to the stoppage of play.

Throw-ins a. A "Throw-in" (i.e.: a player from a point along the fence raises the ball with both hands above the head, with both feet on the ground, and throws it on to the playing surface) always occurs when the ball has been kicked, thrown or propelled in any way outside of the official playing area.

b. When a stoppage of play occurs behind a goal line or within 12 ft. of a goal, the non-offending team receives a "throw-in" from the corner closest to the stoppage of play unless another rule applies (i.e.: touching the ball with hands or arms).

c. The player throwing in the ball must throw the ball with both hands above the head, with both feet on the ground, and cannot throw in the ball to himself or herself by dropping the ball at his or her own feet. If this rule is violated, the thrower forfeits the throw-in to the non-offending team.

d. Regarding a team awarded a "Throw-in", any player on the team may make the "Throw-in". The player who makes the "Throw-in" is usually dictated by the place of the "Throw-in" on the playing surface. Any delay by a team in choosing a player for a "Throw-in" can result in a penalty for delay of game thus forfeiting the "Throw-in" to the non-offending team.

Once the player has the ball, he or she has 5 secs. to make the "Throw-in" or forfeit the "Throw-in" to the non-offending team.

e. The defending team must allow no less than 5 yds. for an offensive player to make a "Throw-in".

Free-kicks a. A "Free-kick" occurs when a player of the non-offending team puts the ball into play by kicking it after the ball has been spotted on the playing surface. The defending team must allow the kicker 5 yds. until the kicker touches the ball.

b. Regarding a team awarded a "Free-kick", any player on the team may make the "Free-kick". The player who makes the "Free-kick" is usually dictated by the place of the "Free-kick" on the playing surface. In the cases of off-sides or grounding usually the goalie makes the "Free-kick" with the rest of his or her team setup in their attacking zone.

The kicker must kick the ball within 5 secs. of the spotting of the ball or receive a penalty for delay of game and forfeit the "Free-kick" to the non-offending team. The kicker can pass the ball or advance it on his or her own.

C. Regarding the placement of the ball for a "Free-kick", the ball should be placed at the point of the infraction unless:

1. When both sides are penalized, a face-off will take place at the center of the closest offside line.
2. If the infraction happens behind the goal line or within 12 ft. of the goal, the non-offending team is awarded a "throw-in" from the corner closest to the infraction.
3. Any penalty which calls for a penalty shot.
4. Hands (Rule) the ball is spotted at the place of the infraction except when in the goal crease, behind the goal line or within 12 ft. of the goal.

Touching the Ball With Hands or Arms a. If a player, except the goalkeeper in his or her goal crease, touches the ball with the hands or arms, the play shall be stopped and a "Free-kick" or "Throw-in" for the non-offending team shall be awarded depending on the position of the infraction.

b. If a defensive player, except the goalkeeper while the play is in progress, touches the ball with the hands or arms in the goal crease area, the play shall be stopped immediately and a penalty shot shall be awarded to the attacking team.

(Note: If a defensive player deliberately uses the hands or arms outside the goal grease to block a sure shot on goal, a penalty shot will be awarded to the non-offending team.)

c. The ball may never be batted by hands or arms; however, a goal shall be allowed if deflected off the hand or arm of a defensive player into the defender's goal.

Grounding the Ball a. For the purpose of this rule, the defending off-side lines will divide the playing surface into two sections. Should any player of a team, equal or superior in numerical strength to the opposing team, kick or deflect the ball from his or her own defensive zone beyond the goal line of the opposing team, play shall be stopped and the non-offending team shall receive a "Free-kick" from the center of their attacking off-side line with their team allowed to setup in their attacking zone. If, however, on such a play the ball shall have entered the goal of the opposing team, the goal shall be allowed.

For the purpose of this rule the point of last contact with the ball by the team in possession shall be used to determine whether grounding has occurred or not.

(Note 1: For the purpose of interpretation of "grounding the ball," the play is stopped the instant the ball is touched first by a defending player (including the goalkeeper) after the ball has crossed the goal line.)

(Note 2: When the ball is kicked and rebounds off the body of an opponent into the opponent's own defensive zone so as to cross the goal line, "grounding the ball" shall not be called.)

c. If a player of the side kicking the ball down the playing surface who is on-side plays the ball before it is touched by a defensive player (including the goalkeeper), the play shall continue and it shall not be considered a violation of "grounding the ball."

d. If, in the opinion of a referee or by mutual agreement of the players, a player of the defensive team (including the goalkeeper), is able to play the ball before it passes his goal line but has not done so, there is no violation and play shall continue.

e. If the ball shall touch any part of a player of the defensive team before crossing the goal line, it shall not be considered "grounding the ball" and play shall continue.

f. If timed penalties are being used, "Grounding the Ball" does not apply to a team below the numerical strength of its opponent due to a penalty.

Offsides a. The position of the player's feet shall be the determining factor in all instances in deciding an "off-side". A player is off-side when both feet are completely over the outer edge of the determining offside line involved in the play.

(Note 1: A player is "onside" when either of the player's feet are in contact with or on his or her own side of the off-side line at the instant the ball completely crosses the outer edge of that line.)

(Note 2: It should be noted that while the position of the player's feet is what determines whether a player is "off-side"; nevertheless, the question of "off-side" never arises until the ball has completely crossed the outer edge of the line, at which time, the decision is to be made.)

b. When an "off-side" occurs, a "free-kick" shall be taken from the center of the non-offending team's attacking off-side line with their team allowed to setup in their attacking zone.

c. A player actually propelling the ball who shall cross the off-side line ahead of the ball shall not be considered "off-side".

While the invention has been described by means of specific examples in specific embodiments, I do not wish to be limited thereto, for obvious modifications will occur to those skilled in the art without departing from the spirit and scope of the invention.

We claim:

1. A kickball game, to be played by opposing teams, including a substantially closed playing surface bounded on all sides by a fence like barrier, the improvement comprising, said fence like barrier being portable and including a plurality of vertical poles any adjacent two of which define a barrier section, and a net member comprising a flexible fabric like material in sheet form, attachment means on said poles for detachably securing said net member thereto at spaced intervals along the length of each of said poles, base portions for said poles, each of said poles being detachably secured to a respective base portion and while secured thereto being in fixed vertical position, each of said base portions being substantially flat on at least the ground surface thereof and being of sufficient square surface area and weight to support a respective one of said poles, said poles being attached to said respective base portions at an edge thereof whereby the base portion is outside the said playing surface entirely.

said net member being a one quarter inch synthetic polymer fabric of open mesh construction and the mesh size being approximately two inches square such that the net member weight and degree of resiliency is sufficient to keep a ball in play following impact therewith at any angle, said net member being approximately four feet high and extending upwardly the full height thereof along each of said poles beginning approximately at the juncture of each of said poles and a respective base portion.

2. The game as claimed in claim 1 wherein, said net member, poles, and base portions are in kit form together with a soccer type ball and an instruction book pertaining to set up and method of play.

3. The game as claimed in claim 1 including, a goal member established at each end of said playing surface, each said goal member consisting of a substantially rectangular box-like structure including an open front end, two side panels and a back panel opposite said open front end, said open front end being open to the midpoint of said playing surface.

* * * * *